United States Patent [19]

Schrammel et al.

[11] 3,999,923

[45] Dec. 28, 1976

[54] INJECTION-MOLDING APPARATUS

[75] Inventors: Werner Schrammel, Emmendingen; Wolfgang Spath, Lahr, both of Germany

[73] Assignee: Klockner-Werke AG, Duisburg, Germany

[22] Filed: Feb. 21, 1975

[21] Appl. No.: 551,842

[30] Foreign Application Priority Data

Feb. 23, 1974 Germany ..... 2408878

[52] U.S. Cl. ..... 425/244; 425/245 R; 425/252

[51] Int. Cl.[2] ..... B28B 3/08

[58] Field of Search ..... 425/244, 245 R, 252

[56] References Cited

UNITED STATES PATENTS

| | | | |
|---|---|---|---|
| 642,581 | 2/1900 | Callaway | 425/327 |
| 2,862,240 | 12/1958 | Strauss | 425/245 X |
| 3,611,505 | 10/1971 | Weber et al. | 425/244 |
| 3,723,037 | 3/1973 | Formo | 425/252 X |

FOREIGN PATENTS OR APPLICATIONS

| | | | |
|---|---|---|---|
| 993,519 | 11/1951 | France | 425/244 |
| 697,034 | 9/1940 | Germany | 425/244 |
| 664,082 | 1/1952 | United Kingdom | |

*Primary Examiner*—Richard B. Lazarus
*Assistant Examiner*—John E. Roethel
*Attorney, Agent, or Firm*—Michael J. Striker

[57] ABSTRACT

An injection-molding apparatus for making ceramic moldings has a mold provided with a mold cavity, a structure formed with a passage which communicates with the mold cavity, and an injecting arrangement for injecting the molding material via the passage into the cavity. The injecting arrangement has a cylinder a front end of which is provided with an outlet communicating with the passage, and which also has a material inlet rearwardly spaced from the outlet. A ram is reciprocable in the cylinder between a first end position in which it is located rearwardly of the inlet and another end position in which it is located forwardly of the inlet and close to the outlet. The ram carries a rearwardly extending skirt which extends across the inlet when the ram is in its forward or second end position, so as to prevent material from entering the cylinder behind the ram through the inlet.

7 Claims, 3 Drawing Figures

INJECTION-MOLDING APPARATUS

BACKGROUND OF THE INVENTION

The present invention relates generally to an injection-molding apparatus, and more particularly to an injection-molding apparatus for making ceramic moldings.

Ceramic moldings have been conventionally produced by various pressing operations. However, it is now also known from the prior art to produce them by injection molding using a molding apparatus having a stationary plate carrying one part of a mold and a movable plate having another part of the mold, so that the mold parts together form the mold cavity. The stationary mold part, that is the one on the stationary plate, has a bore through which the ceramic mass that is to be converted into a ceramic molding, is admitted into the mold cavity. After the material has been admitted into the mold cavity, a compacting pressure is exerted upon it and thereupon the mold is opened and the finished ceramic molding is removed.

As compared to the earlier approach to the manufacture of ceramic moldings, i.e., ceramic bodies, this latter prior-art proposal provides a significant advantage in terms of manufacturing speed. However, it also still suffers from certain disadvantages. One of these results from the fact that this latter prior-art proposal utilizes an injection cylinder to which the ceramic material is supplied in form of plugs on a conveyor, which plugs are then pushed into the cylinder by a piston before they can be injected from the cylinder and into the mold. This construction is of necessity very long and therefore requires significant space that is often at a premium. Moreover, free access to the arrangement is difficult because of the auxiliary components, such as the conveyor, and the feeding speed of the conveyor must be precisely coordinated with the reciprocating speed of the piston and with the opening and closing movements of the mold, since otherwise the apparatus will malfunction.

Moreover, the compacting pressure that is exerted in this prior art upon the material admitted into the mold cavity, is exerted by means of a pin which enters via an opening formed in the mold. It has been found that frequently some of the material will run back out of the mold cavity and foul the opening into which the pin exerting the compacting pressure must be able to enter. This causes operating difficulties.

SUMMARY OF THE INVENTION

Accordingly, it is a general object of this invention to overcome the disadvantages of the prior art.

More particularly, it is an object of the present invention to provide an improved injection-molding apparatus which is particularly suitable for making ceramic moldings, and which avoids the aforementioned disadvantages.

Another object of the invention is to provide such an improved injection-molding apparatus which permits simple and unhindered access to all components of the apparatus.

A further object of the invention is to provide such an apparatus wherein a backflow of injected material cannot take place.

In keeping with these objects, and with others which will become apparent hereafter, one feature of the invention resides in an injection-molding apparatus, particularly for making ceramic moldings, which comprises mold means having a mold cavity, passage-forming means having a passage which communicates with the mold cavity, and injecting means for injecting the molding material via the passage into the cavity. The injecting means comprises a cylinder having a front end provided with an outlet which communicates with the passage, a material inlet rearwardly spaced from the outlet, a ram reciprocable in the cylinder between the first end position in which it is located rearwardy of the inlet, and a second end position in which it is located forwardly of the inlet and close to the outlet, and a skirt projecting rearwardly from the ram and extending across the inlet when the ram is in the second end position so as to prevent molding material from entering the cylinder behind the ram.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
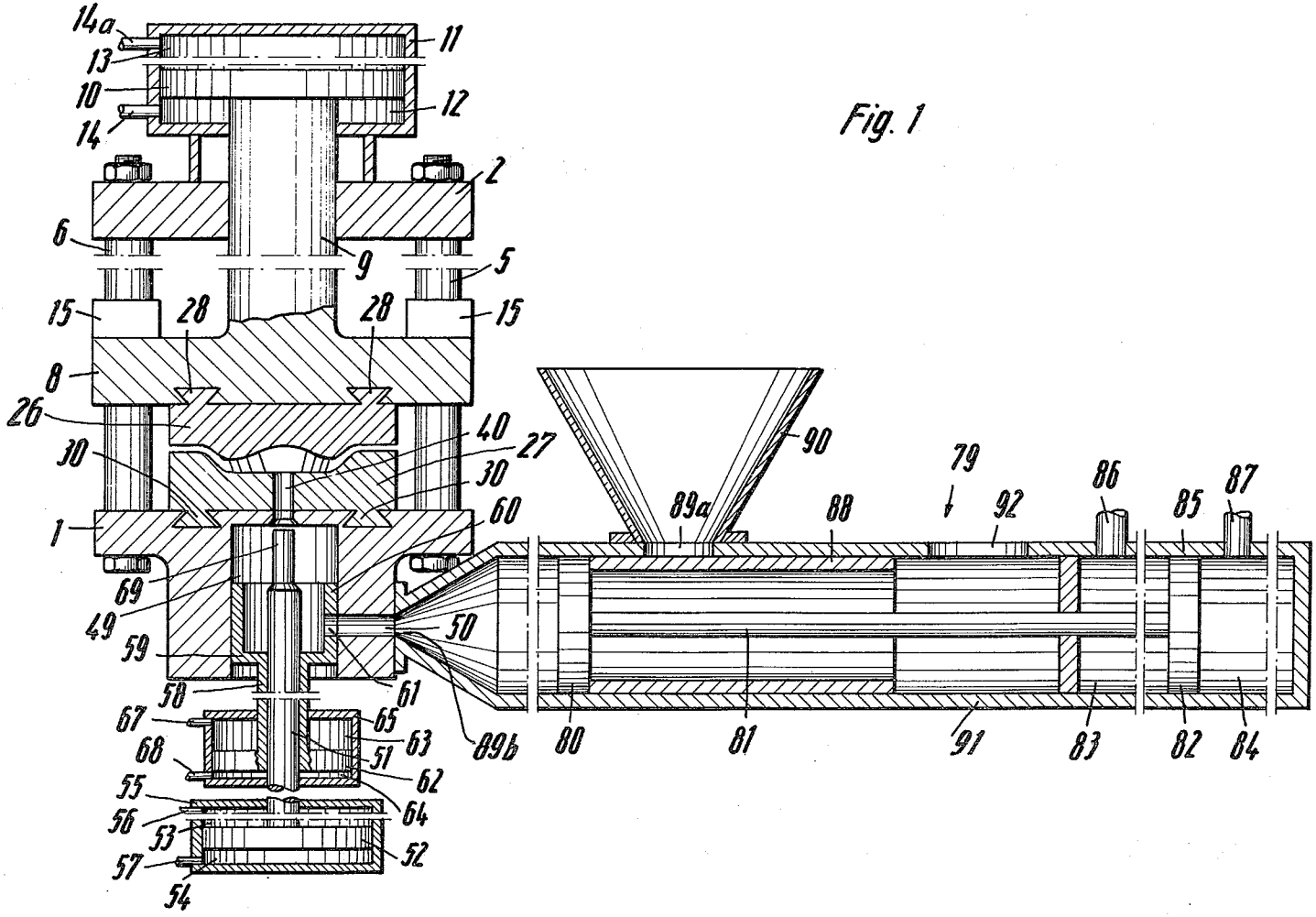
FIG. 1 is an axial section through an apparatus according to the present invention.
Figure 2:
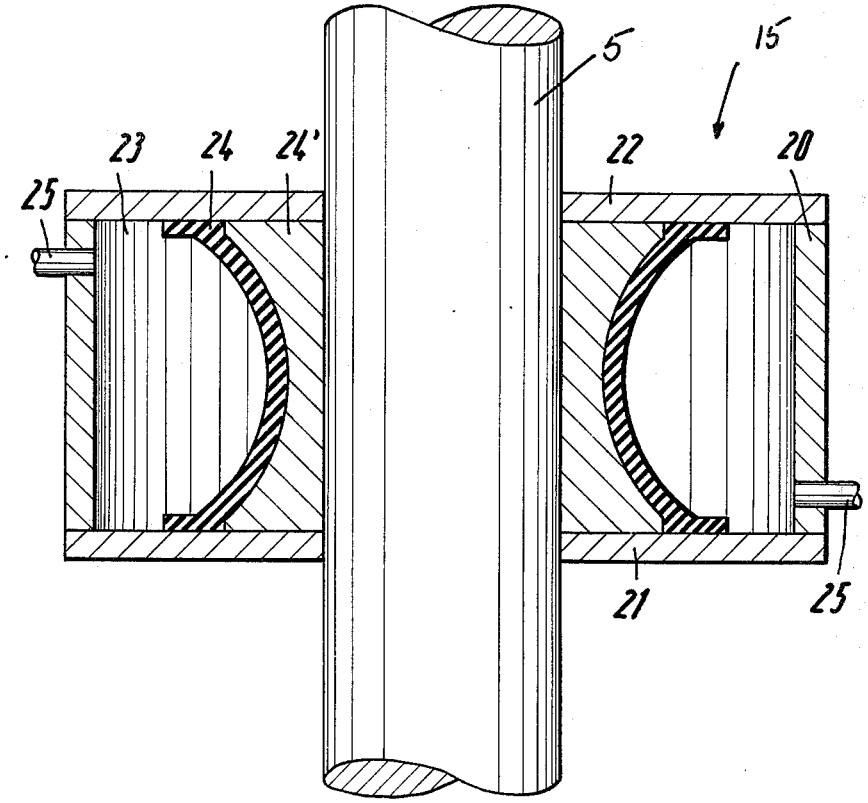
FIG. 2 is a sectional view illustrating a detail of the apparatus in FIG. 1.

Referring to FIGS. 1 and 2, it will be seen that the apparatus has a fixedly mounted carrier plate 1 on which the mold half 27 is mounted. For this purpose, the carrier plate 1 is formed with undercut (e.g., dovetailed) grooves in which matingly configurated projections 30 of the mold half 27 are received. A second plate 2 is upwardly spaced from the plate 1 and connected with the same by means of a plurality of uprights; as FIG. 1 is a vertical section for the apparatus, only the uprights 5 and 6 which are located behind the plane of the section are visible, The uprights 5, 6 together with the plates 1 and 2 form a rigid frame which is mounted on the (not illustrated) machine frame or support.

Vertically displaceable along the uprights 5 and 6 is a movable mold plate 8 which carries the upper mold half 26; the mold plate 8 is also provided with undercut grooves in which matingly configurated projections 28 of the mold half 26 are received. The upper side of the mold plate 8 is provided with an upright extension 9 that passes through an opening in the plate 2 and constitutes the piston rod of a piston 10 which is located in the interior of a hydraulic cylinder 11 wherein it forms pressure chambers 12 and 13, respectively. The chambers 12 and 13 are provided with fluid ports 14 and 14*a*, respectively, by means of which they can be connected to not illustrated pressure fluid lines which receive pressure fluid from a similarly not illustrated source.

Also mounted on the upwardly directed side of the plate 8 is a plurality of pressure housings 15 each of which surrounds and embraces one of the uprights 5, 6; since only two of the uprights 5, 6 are visible in FIG. 1, only two of the housings 15 are shown. FIG. 2 shows that each of the housings 15 is composed of a cylindrical circumferential wall 20, the opposite open ends of which are closed by end plates 21 and 22, respectively; these end plates have central holes through which the respective upright (the upright 5 as shown in FIG. 2) extends. Located in the interior surrounded by the walls 20, 21 and 22 is an annular elastically deformable pressure member 24 of natural or synthetic rubber or synthetic plastic material which forms exteriorly of itself an annular pressure chamber 23; surrounded by the member 24, and located between the inwardly directed surface thereof and the outer surface of the upright, are clamping members 24'. When the mold is closed by operation of the piston 10 so that the mold parts 26 and 27 define with one another the mold cavity, pressure fluid is admitted into the pressure space 23 of the respective housings 15; this causes pressure to be exerted upon the pressure member 24 which thereby forces the members 24' against the associated upright, thus clamping the plate 8 in position on the upright 5, 6 and preventing the upper mold half 26 from being pushed upwardly and away from the lower mold half 27 when ceramic material is injected into the mold cavity. The admission of the pressure fluid is effected by means of the ports 25 which are, of course, again to be connected with a source of such pressure fluid, for instance hydraulic fluid. The two mold parts 26 and 27 form the mold cavity which is symmetrical with respect to the axis of the mold and which may have any desired configuration, for instance the configuration of a plate as in the illustrated embodiment. The ceramic material which is to be converted into a ceramic molding or body is admitted into the mold cavity by means of an inlet 40 which communicates with a pressure chamber 49 formed in the plate 1; a passage 50 is also formed in the plate 1 and extends radially of and communicates with the pressure chamber 49.

A piston rod 51 extends coaxially through the chamber 49 and is reciprocable axially of the latter; at the end remote from the chamber 49, the piston rod is provided with a piston 52 which is located in a cylinder 55 wherein it forms two pressure chambes 53 and 54 which are provided with ports 56 and 57 for connection to a source of hydraulic pressure fluid. The piston rod 51 is in part surrounded by a sleeve 58 which is provided at its end that is closest to the chamber 49 with a hollow cylindrical piston 59 having a circumferential wall 60 formed with a slot-shaped opening 61. The opposite end of the sleeve 58 is provided with a piston 62 which is located in a cylinder 65 and forms two pressure chambers 63 and 64 therein. The chambers 63 and 64 are provided with ports 67 and 68 for connection to a source of hydraulic pressure fluid. The cylinder 65 is fixedly connected with either the piston rod 51 or the machine frame.

At its axial end facing towards the inlet 40, the piston rod 51 is provided with a pin 69 that is intended to provide compacting pressure upon the ceramic material located in the molding cavity of the mold composed of the mold parts 26 and 27. The length of the pin 69 is so selected that it can sealingly enter into the inlet 40 and in its upper most position will have its free end face located in the plane of the bottom wall of the mold cavity, i.e., in the plane of the lower surface of that part of the mold cavity which is formed in the mold part 26. This measure assures that no material can backflow from the mold cavity into the inlet 40 and remain therein, and it also assures that the molding that is produced in the mold cavity will not be formed with a flashing or the like.

During the injection of the ceramic molding material (which, of course, has not been fired), the piston 59 assumes the position shown in FIG. 1 in which the opening 61 registers with the passage 50 so that material injected through the passage 50 can enter into the interior of the piston 59 and from there via the inlet 40 into the mold cavity. At this time, the free end of the pin 69 is withdrawn from and spaced relative to the inlet 40 so that the ceramic material can freely flow via the inlet 40 into the mold cavity. As soon as the mold cavity is filled with the material, the pressure exterted by the ceramic material upon the piston 59 rises and after a predetermined back pressure is exceeded, the further movement of the injecting ram (to be discussed subsequently) is terminated. Hydraulic fluid is now admitted into the pressure chamber 54 to cause the piston 52 to move upwardly so that the piston rod 51 moves toward the inlet 40, and at the same time pressure fluid is admitted into the pressure chamber 63 to cause the piston 59 to perform a movement opposite to that of the piston 52, meaning that the piston 59 moves in a direction counter to the advancement of the piston rod 51 and the opening 61 moves out of registry with passage 50. Communication between the cylinder serving to inject the material and the passage 50 is now interrupted. Continued movement of the piston rod 51 towards the mold parts 26, 27 causes the pin 69 to enter into the inlet 40, blocking the same against backflow of material and pushing any material in it into the mold cavity, thus exerting a compacting pressure upon the material which assures that all parts of the mold cavity are uniformly filled. The maximum value of the pressure that is so exerted depends upon the end position of the pin 69; as pointed out previously, the free end of the pin 69 will be located flush with the bottom wall of the mold cavity when the pin is fully inserted. This eliminates the possibility that flashings might form on the molded article, and overcomes backflow of ceramic material not only through the inlet 40 but also eliminates, by virtue of the presence of the pin 69 as well as the out-of-registry movement of the opening 61, any further flow through the passage 50 in either direction. The formation of plugs of material in the inlet 40 and the passage 61 is thereby avoided, and the possibility of operating difficulties due to such formation is averted.

The injection of the material is effected via the injection arrangement 79 having a ram 80 which is reciprocable in a cylinder 91. A piston rod 81 of the ram 80 extends rearwardly and into a further cylinder 85, which may be a separate element secured to the cylinder 91, or simply a separate compartment (as shown) subdivided from the main compartment of the cylinder 91 by a transverse wall through an opening of which the rod 81 extends. In the cylinder 85, the piston rod 81 carries a piston 82 which subdivides the interior of the cylinder 85 into the pressure chambers 83 and 84 which communicates in a not illustrated manner via the hydraulic fluid ports 86 and 87, respectively. The front end of the cylinder 91 is provided with an outlet opening **89*b* which communicates with the passage 50 and advantageously has a cross-sectional area corresponding to that of the passage 50. Rearwardly of the outlet 89*b*, the cylinder 91 is provided with a feed hopper 90 from which material is fed via the inlet 89*a* into the interior of the cylinder 91. When the ram 80 is in the opposite end position from the one illustrated in FIG. 1, that is when it is withdrawn to the right of the inlet 89***a*, material will enter from the hopper 90 into the interior of the cylinder 91 to be injected into the passage 50 as the ram 80 moves forwardly to its illustrated position in which it is located to the left of the inlet 89*a*. In this latter position, material could enter the cylinder 91 from the inlet 89*a* behind the ram 80 and this would lead to substantial operating difficulties. To avoid this, the ram 80 is provided with a rearwardly extending skirt 88 which may be tubular, as shown, but need not have that configuration, but which in any case must extend across the inlet 89*a* when the ram 80 is located in the position shown in FIG. 1, so as to prevent the entry of material into the cylinder 91 behind the ram 80. It is advantageous to provide the cylinder 91 with a clean-out opening 92 so that in the event that some obstructing material should for some reason enter the cylinder 91 behind the ram 80, it can be removed through the opening 92. A cover may also be provided for this opening.

The entire hydraulic system for effecting all movements in the apparatus of FIGS. 1 and 2 is known from the art and need not be further discussed. It will be mounted in or on the machine frame or base and will be connected in known manner with the various ports which have been illustrated.

Figure 3:
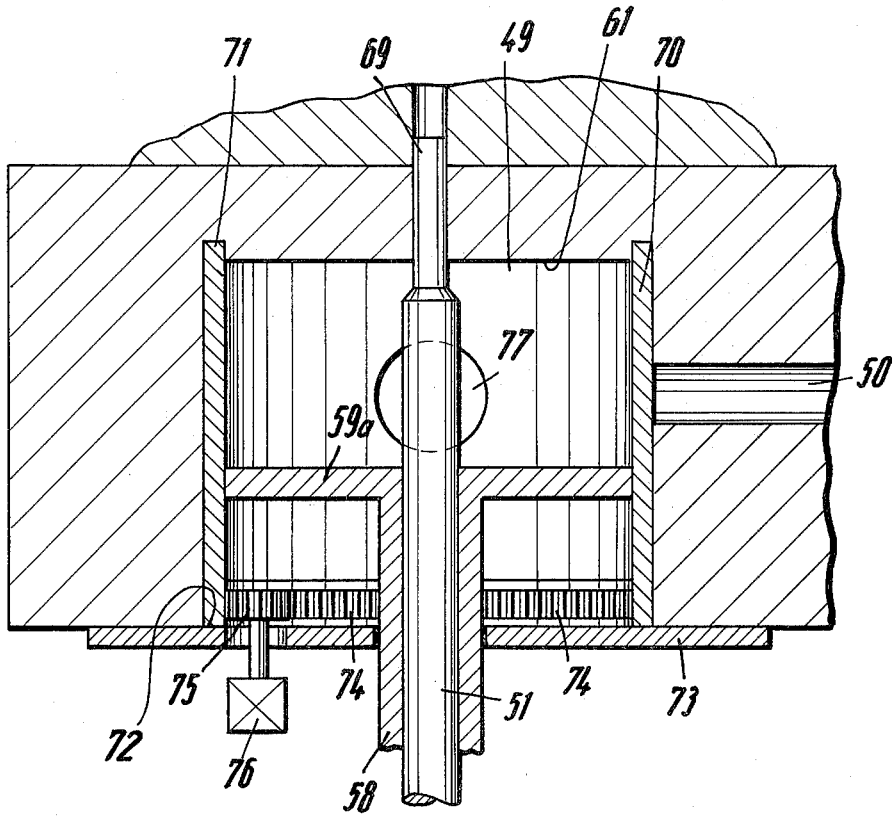
FIG. 3 is a sectional view illustrating a detail of a further embodiment of the invention.

In the embodiment of FIGS. 1 and 2, the fact that the opening 61 must be able to move into and out of registry with the channel 50, means that the cross-sectional area of the channel—and in particular its dimension in vertical dimension in FIG. 1—can be only relatively small. It is, however, desirable to make the cross-sectional area of the channel 50 as large as possible in order to be able to inject the ceramic material without having to exert very high pressure upon it via the ram 80. FIG. 3 shows an embodiment which meets this requirement and which can be used in the apparatus of FIGS. 1 and 2; the latter can in all respects by similar to what is illustrated in FIGS. 1 and 2.

The arrangement in FIG. 3 again has the piston rod 51 which is surrounded by the sleeve 58; however, in this case, the sleeve 58 carries only a tranverse wall 59*a* that serves as a piston; where the circumferential wall 60 was of one piece with the transverse wall in FIGS. 1 andd 2, the circumferential wall 70 in the embodiment of FIG. 3 is tubular and is separate from the piston 59*a*. Its upper end portion 71 extends into an annular groove formed in the upper end wall 61 which bounds the chamber 49, whereas the lower end portion 72 abuts against an annular plate 73 that is fixedly mounted (e.g., by means of a flange or the like) on the fixed plate 1 (which is not shown in FIG. 3). In the region of the lower end 72, the inner circumferential surface of the sleeve 70 is formed with a circumferentially extending annulus of teeth 74 which mesh with the teeth of a pinion 75 that can be rotated by a motor 76. The wall 70 is further provided with an opening 77 having the same cross-sectional area as the channel 50 or, as in the illustrated embodiment, having a cross-sectional area that is somewhat larger than that of the channel 50.

In this embodiment, it is the wall or sleeve 70 which is turned by rotating the pinion 75 upon energization of the motor 76, so that the opening 77 can be brought into or out of registry with the passage 50. This embodiment makes it possible to select the diameter of the channel 50, that is its cross-sectional area, much larger than in the embodiment of FIGS. 1 and 2 because in FIG. 3 no actual reciprocation of the sleeve 70 is required. The cylinder and piston arrangements which effect the movements of the piston rod 51 and of the sleeve 58, as well as the other aspects of FIGS. 1 and 2 directed to the movement of the mold portions and the injection of material via the passage 50, are the same in the embodiment of FIG. 3 and are therefore not illustrated.

After the ceramic material has been injected via the passage 50 and the chamber 49 into the mold cavity, the motor 76 is energized to cause the sleeve 70 to turn to a position in which the opening 77 is out of registry with the passage 50 to prevent any further flow of ceramic material. The other movements with respect to the piston rod 51 and the sleeve 58, as well as with respect to the pin 69, are the same as described earlier with respect to FIGS. 1 and 2.

By resorting to the present invention, it is now no longer necessary to supply the ceramic material to the cylinder 91 in accordance with the working rhythm of the machine and by means of a conveyor belt or the like, since the openings 61 or 67 are moved into and out of registry with the passage 50 in accordance with the working rhythm, i.e., slower or faster in dependence upon the working rhythm.

It will be understood that each of the elements described above, or two or more together, may also find a useful application in other types of constructions differing from the type described above.

While the invention has been illustrated and described as embodied in an injection molding apparatus for making ceramic moldings, it is not intended to be limited to the details shown since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

We claim:

1. In an injection-molding apparatus, particularly for making green ceramic bodies, a combination comprising mold means having a mold cavity provided with a charging opening; passage-forming means having a passage which communicates with said mold cavity, including a chamber provided with an inlet port formed in a circumferential wall of said chamber and communicating with said passage and an outlet port formed in an end wall of said chamber and communicating with said charging opening; injecting means for injecting the molded material via said passage into said cavity and comprising a cylinder having a front end provided with an outlet which communicates with said passage, a material inlet rearwardly spaced from said outlet, a ram reciprocable in said cylinder between a first end position in which it is located rearwardly of said inlet and a second end position in which it is located forwardly of said inlet and close to said outlet, and a skirt projecting rearwardly from said ram and extending across said inlet when said ram is in said second end position so as to prevent molding material from entering said cylinder behind said ram; and blocking means in said chamber and movable, subsequent to reciprocation of said ram to said second end position thereof, from a rest position to a first operating position in which it interrupts communication between said chamber and said passage and charging opening, respectively, and beyond said first operating position in which it continues the interruption of said communication and additionally exerts compacting pressure upon the material in said mold cavity, said blocking means including a tubular element having an interior which communicates with said outlet port and a circumferential wall provided with an opening movable into and out of registry with said inlet port.

2. A combination as defined in claim 10, wherein said skirt is a tubular skirt.

3. A combination as defined in claim 10, wherein the cross-sectional area of said outlet equals the cross-sectional area of said passage.

4. A combination as defined in claim 1, wherein said blocking means comprises reciprocating means for reciprocating said tubular element toward and away from said outlet port.

5. A combination as defined in claim 1, wherein said opening is slot shaped.

6. In an injection-molding apparatus, particularly for making ceramic moldings, a combination comprising mold means having a mold cavity; passage-forming means having a passage which communicates with said mold cavity and which has a chamber provided with an inlet port communicating with said passage, and an outlet port communicating with said mold cavity said inlet port being formed in a circumferential wall of said chamber and said outlet port being formed in an end wall of said chamber; blocking means movable in said chamber between positions in which it respectively blocks and unblocks said inlet port, said blocking means comprising a tubular element turnable in said chamber and having an interior which communicates with said outlet port and a circumferential wall provided with an opening which is movable into and out of registry with said inlet port; injecting means for injecting the molding material via said passage into said cavity, comprising a cylinder having a front end provided with an outlet which communicates with said passage, a material inlet rearwardly spaced from said outlet, a ram reciprocable in said cylinder between a frist end position in which it is located rearwardly of said inlet and a second end position in which it is located forwardly of said inlet and close to said outlet, and a skirt projecting rearwardly from said ram and extending across said inlet when said ram is in said second end position so as to prevent molding material from entering said cylinder behind said ram; and turning means for turning said tubular element relative said chamber.

7. A combination as defined in claim 6, wherein said turning means comprises a drive, and rack-and-pinion means for transmitting motion from said drive to said tubular element.

* * * * *